US005735632A

United States Patent [19]

Braverman

[11] Patent Number: 5,735,632

[45] Date of Patent: Apr. 7, 1998

[54] TRAFFIC MARKER AND BASE UNIT

[76] Inventor: Josef J. Braverman, 32 Loma Vista Drive, Thornhill, Ontario, Canada, L4J 7S3

[21] Appl. No.: 771,694

[22] Filed: Dec. 23, 1996

Related U.S. Application Data

[63] Continuation-in-part of Ser. No. 498,836, Jul. 6, 1995, Pat. No. 5,613,798.

[51] Int. Cl.[6] ..... E01F 9/00

[52] U.S. Cl. ..... 404/6; 404/9; 248/910

[58] Field of Search ..... 404/6, 9, 10, 11; 256/1, 13.1; 116/63 P, 63 C

[56] References Cited

U.S. PATENT DOCUMENTS

| | | | |
|---|---|---|---|
| 237,473 | 11/1881 | Fitch | D10/109 |
| 4,312,600 | 1/1982 | Schaaf et al. | 404/6 |
| 5,199,813 | 4/1993 | Nagler | 404/9 |
| 5,234,280 | 8/1993 | Cowan | 404/6 |

*Primary Examiner*—Henry A. Bennett
*Assistant Examiner*—Pamela A. O'Connor
*Attorney, Agent, or Firm*—R. Craig Armstrong

[57] ABSTRACT

A traffic channelizing device has a base unit made from the sidewalls of used tires, and additional tire components such as tread portions or other sidewalls, at least partially secured between the sidewalls. Tread portions may be wound spirally between opposing sidewall portions, or horizontally-arranged sidewalls may be positioned partially between the opposing sidewall portion, and may be cut and shaped to a non-circular inner shape to accommodate barrels which have a non-circular shape. Wire ties or the like are used to bind the sidewalls to produce an irregular exterior shape, so that the devices are not inclined to roll when overturned. The base separates readily from the barrel in the event of an impact.

9 Claims, 8 Drawing Sheets

TRAFFIC MARKER AND BASE UNIT

REFERENCE TO RELATED APPLICATION

This is a continuation-in-part of application Ser. No. 08/498,836, filed on Jul. 6, 1995, now U.S. Pat. No. 5,613,798.

BACKGROUND OF THE INVENTION

This invention relates to a base unit for attachment to a traffic channelizing device, using recycled vehicle tires.

Devices used for diverting or directing vehicular traffic, particularly on road construction sites, commonly comprise hollow plastic ballast-filled containers, such as a conical or cylindrical barrels with a weighting means such as sand within the barrel portion, or such containers with sandbags or other ballast means stacked inside or outside, to provide a low centre of gravity or an anchor to ensure that the device remains upright and in its desired location. The barrel portion of such devices is generally constructed of a material having a good resistance to extreme weather conditions, and a resilience so as to maintain the integrity of the devices despite frequent impacts from traffic or during handling, without creating excessive hazards to vehicles. Recent developments in such devices have included the use of the sidewall portion of used truck tires, mounted as a base to a body portion.

Existing devices suffer from the disadvantages of being cumbersome to install, remove or transport to another location. Devices using sand as ballast suffer from the further disadvantage of loss of sand in the event of breakage of the bags or plastic containers. Devices using the sidewalls of large truck tires have the advantage of recycling parts of used tires, but require a large space for the base; such space is frequently not safely available in the situations which require the use of channelizing devices. Existing devices using the sidewalls of truck tires also have the propensity to roll if knocked over, potentially creating a serious hazard to traffic. If increased stability is achieved by stacking several tire sidewalls, the safety requirement that the base be separable from the body portion in high impact is jeopardized.

SUMMARY OF THE INVENTION

It has been found that a more stable device having a smaller base can be made by using the sidewalls and tread portions of tires, such as car tires, bound together in unique configuration. The sidewalls are tied with wire to produce an irregular outer shape so that the device is not prone to rolling when overturned. Sidewalls may be cut and tied appropriately to produce a variety of central aperture shapes, corresponding to different sizes and shapes of barrels or the like.

The device has the advantages of being highly resistant to wind and impact, yet being readily removable with substantially less manpower and transportation space than for existing devices. Enhanced separability of components on impact also results, for improved safety.

BRIEF DESCRIPTION OF THE DRAWINGS

The invention will now be described with reference to preferred embodiments by way of example, as illustrated in the accompanying drawings, in which.

DETAILED DESCRIPTION OF THE PREFERRED EMBODIMENT

Figure 1:
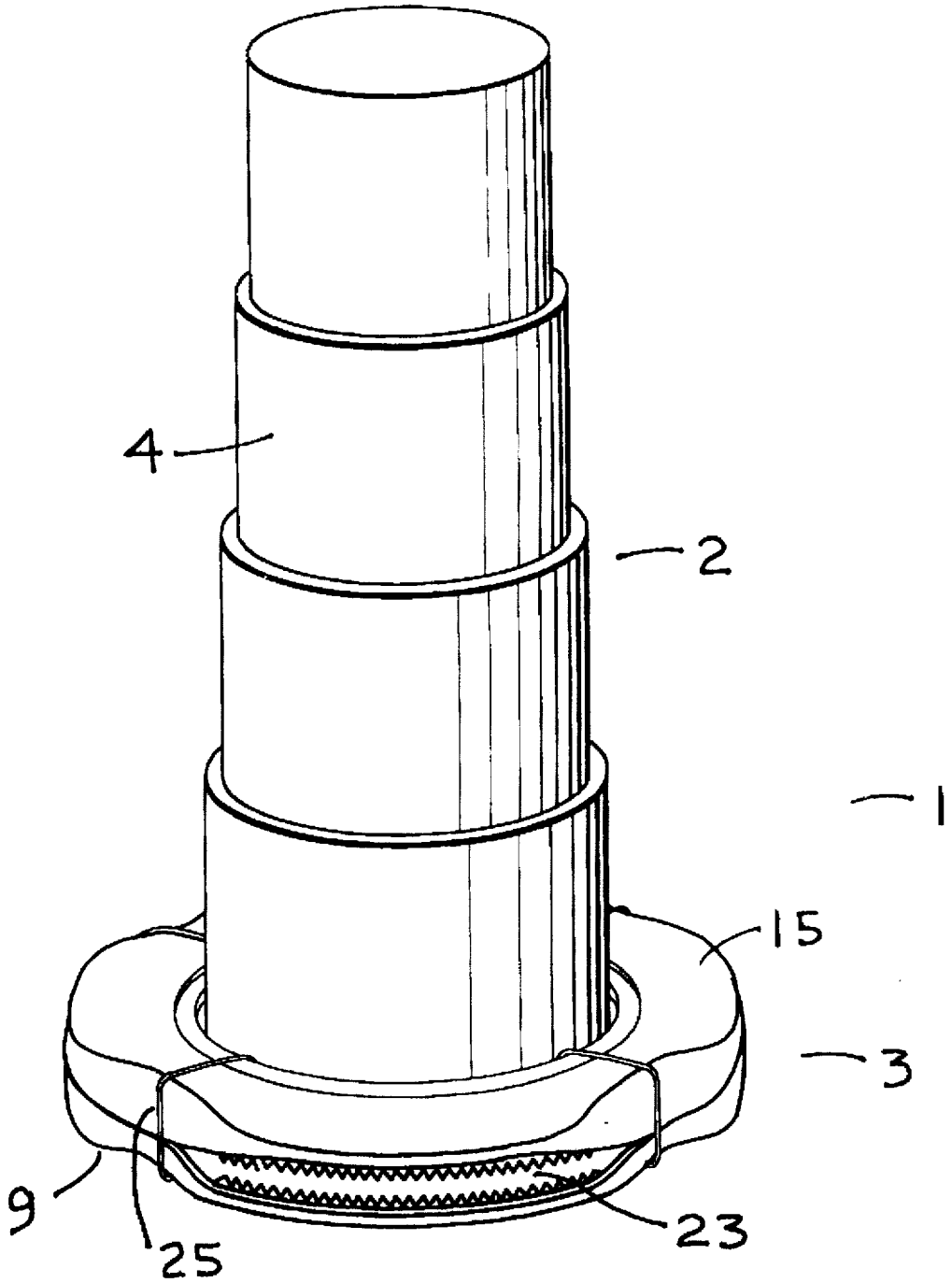
FIG. 1 is a perspective view of one embodiment of the invention.

Referring to FIG. 1, a traffic channelizing device 1 comprises a body portion 2 and a base unit 3. The body portion has a vertically tapered body 4, which can have any suitable tapered configuration ranging from a cone to a slightly tapered or stepped cylinder, oval, or polygon. The lower extremity of the body portion ends in a flange 6, which rests on the ground 8.

The body portion 2 can be constructed of any suitable weather and impact resistance material, preferably a lightweight material such as polyethylene.

The base unit 3 comprises a lower sidewall 9, having a planar portion 11 and a curved portion 12. The base has a central hole 13 of a diameter selected for the desired fit to the lower extremity of the body portion 2. The convex surface 14 of the curved portion 12 rests on the ground surface 8. An upper sidewall 15 comprises a planar portion 16 and a curved portion 18. To achieve maximum stability of the device 1, the desired fit for the base near the bottom of the device is an interference fit. However, the upper sidewall preferably has clearance to maintain the separability of the base unit 3 from the body portion 2 in the event of an impact.

The upper sidewall 15 is placed over the lower sidewall 9 so that it faces the lower sidewall, with the concave surfaces 21 of the curved portions 12 and 18 of the sidewalls face each other, forming an annular channel 22.

Figure 2:
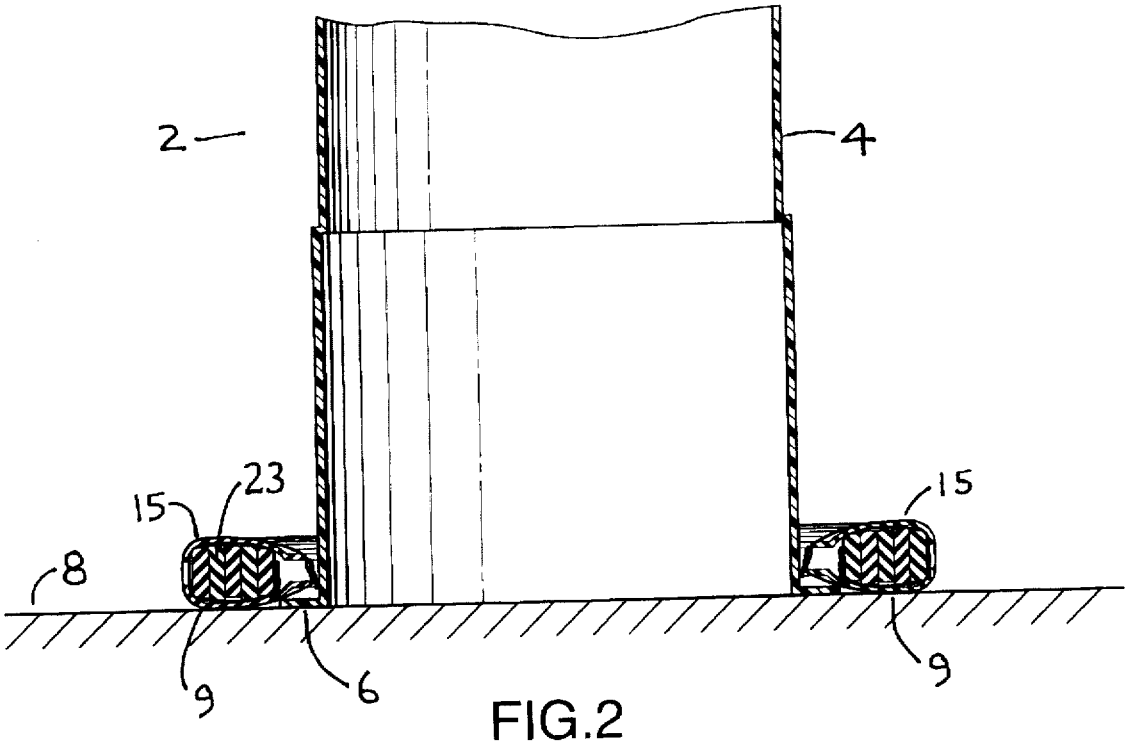
FIG. 2 is a vertical cross-section of the embodiment shown in FIG. 1.
Figure 3:
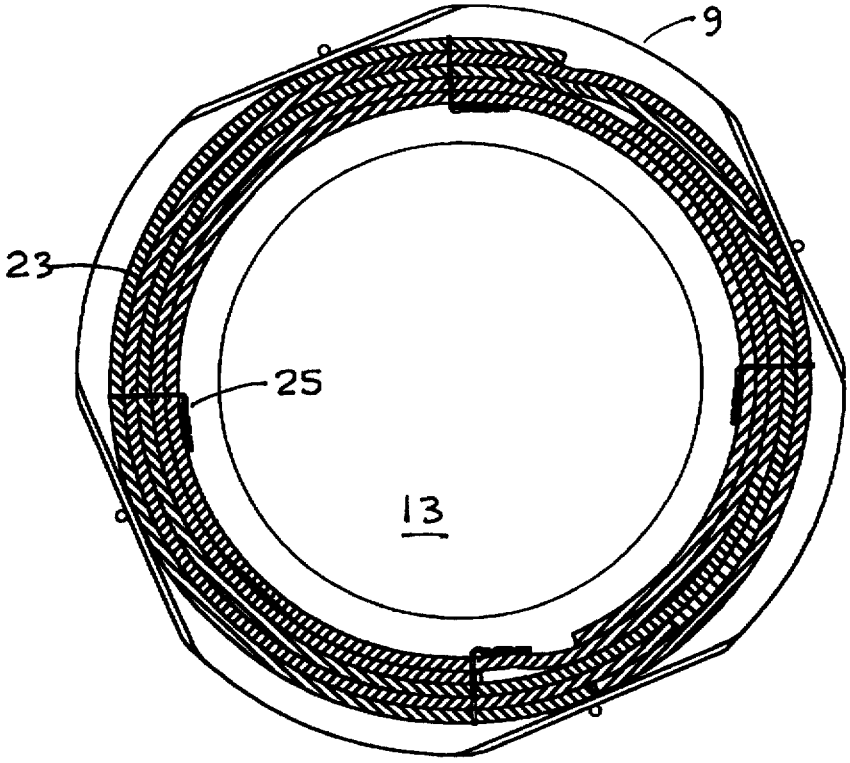
FIG. 3 is a horizontal cross-section of the base portion of the embodiment shown in FIG. 1.

Referring to FIGS. 2 and 3, a tread strip 23 cut to a suitable width from at least one tire can be wound spirally within the channel to fill the space between the concave surfaces, as one means of using other components of tires to produce the desired low center of gravity. The wound tread strips can be secured by a suitable means such as nuts and bolts passing through the treads, or by wire ties 25 as illustrated. The treads are cut lengthwise prior to winding, to reduce their width and thus reduce the overall height of the base.

The sidewalls can be selected from any suitable size of tires; used tires from cars are particularly advantageous as to size and weight. It has been found that the desired fit and clearance for the sidewalls is readily obtained for a commonly used size of body portion by the use of the sizes R15 for the lower sidewall 9 and R16 for the upper sidewall 15. However, the same size tire sidewalls can be used for the lower and upper parts if desired.

Figure 7:
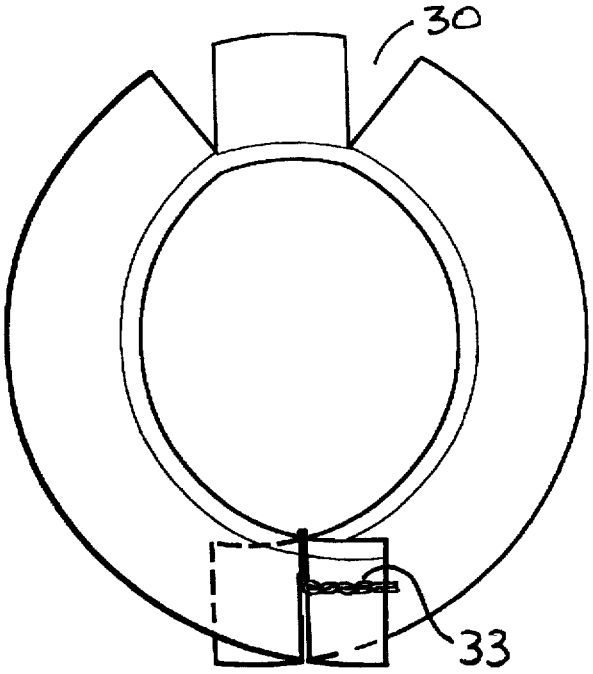
FIG. 7 is a plan view showing the sidewall tied to produce the oval central aperture.
Figure 8:
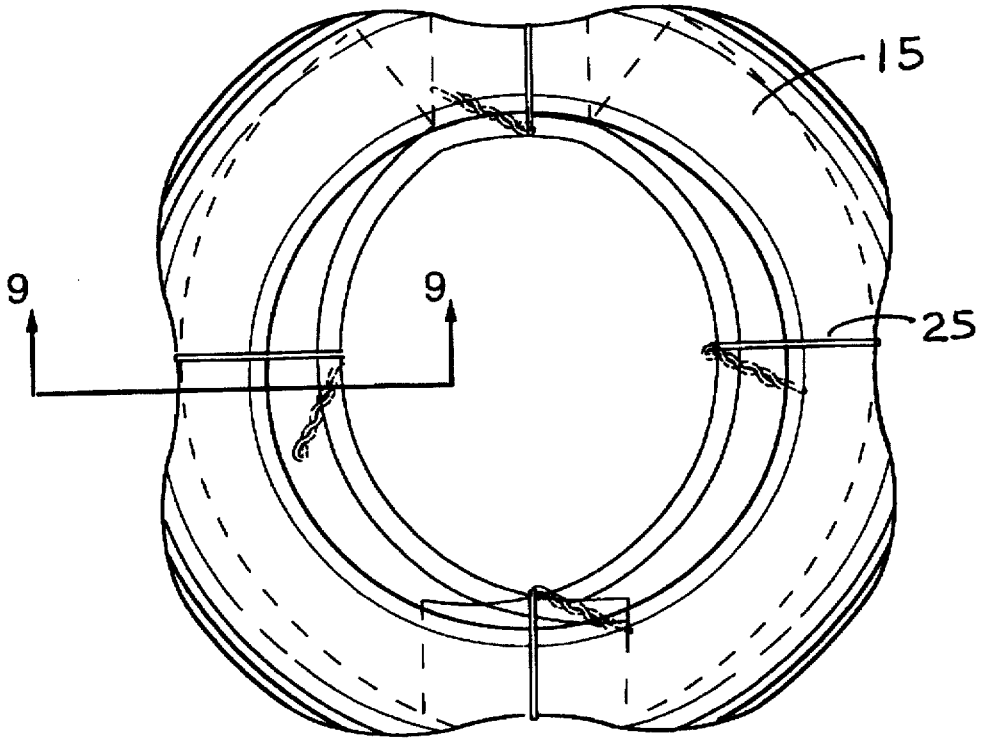
FIG. 8 is a plan view of inner and outer sidewalls, showing the overall base with an irregular outer shape and an oval inner shape.
Figure 9:
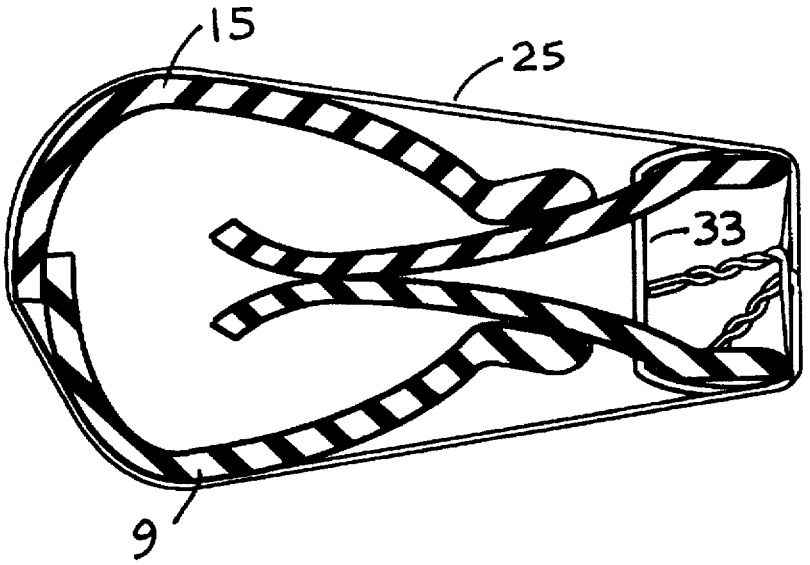
FIG. 9 is a cross-section at 9—9 of FIG. 8.

An alternative construction is as illustrated in FIGS. 6–16. Tire sidewalls are cut to provide large slots 30 and small slots 31, as well as a "through" cut 32. As shown in FIG. 7, the pattern of cuts in FIG. 6 can be used to produce a generally oval inner shape, for an oval barrel. The large slots allow the sidewall to flex appropriately for the desired shape, and the small slots allow the ends created by the through cut to be overlapped and tied by wire ties 33. FIGS. 8 and 9 show the FIG. 6–7 sidewalls positioned between the upper and lower sidewalls, the whole assembly then being tied by wire ties 25.

Figure 10:
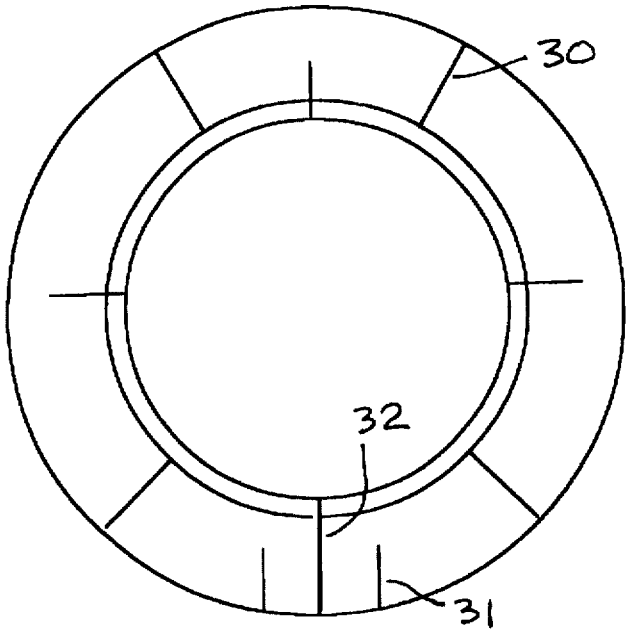
FIG. 10 is a plan view showing a pattern of cuts to produce a generally square central aperture.
Figure 11:
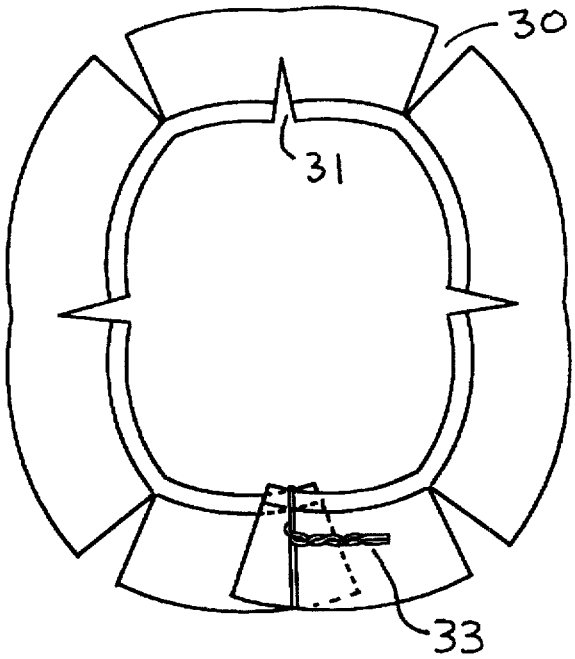
FIG. 11 is a plan view showing the sidewall tied to produce the generally square central aperture.
Figure 12:
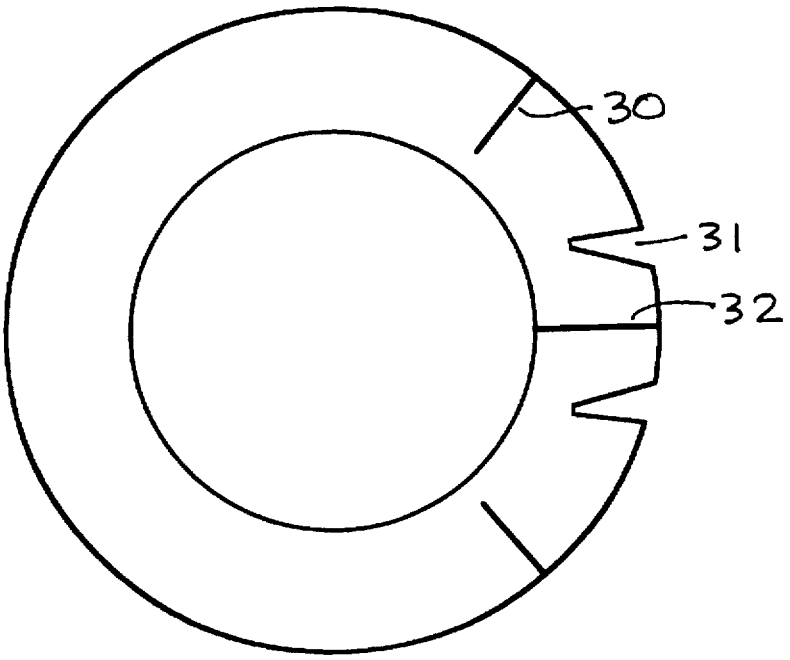
FIG. 12 is a plan view showing a pattern of cuts to produce a generally D-shaped central aperture.
Figure 13:
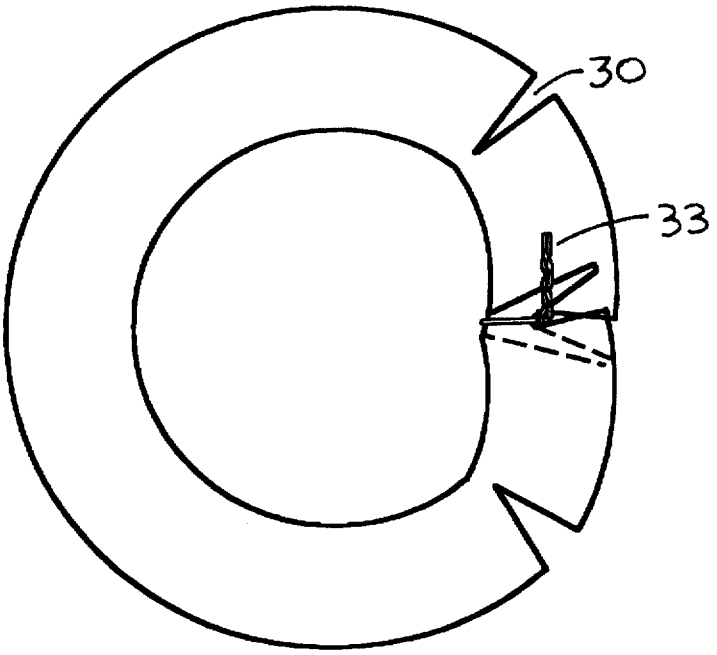
FIG. 13 is a plan view showing the sidewall tied to produce the generally D-shaped central aperture.
Figure 14:
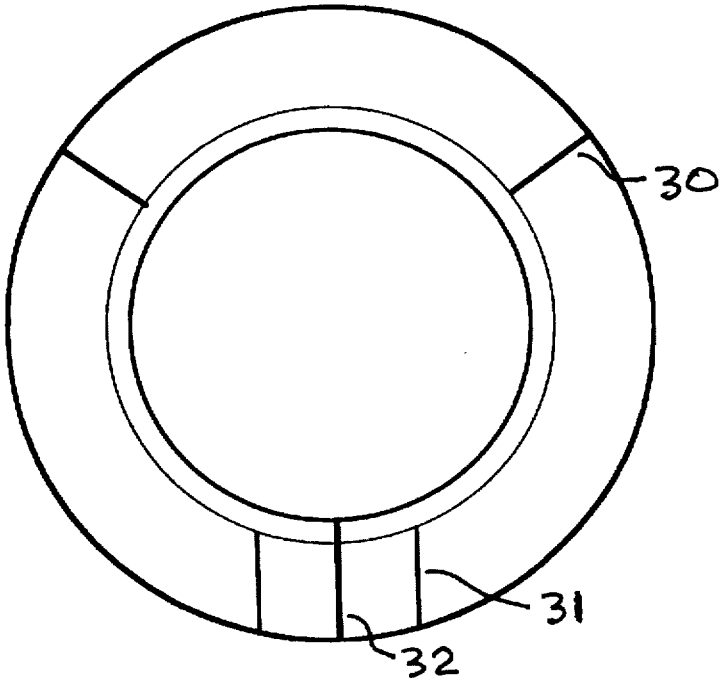
FIG. 14 is a plan view showing a pattern of cuts to produce a rounded triangular central aperture.
Figure 15:
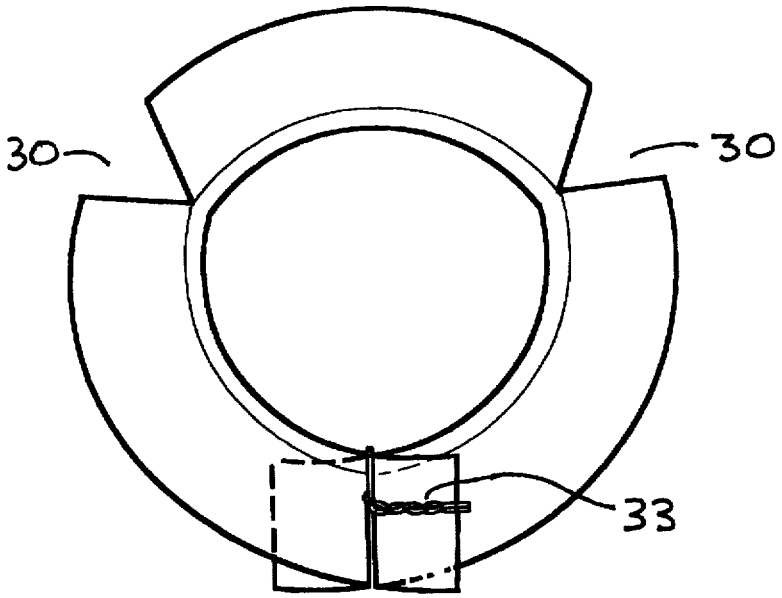
FIG. 15 is a plan view showing the sidewall tied to produce the rounded triangular central aperture.

FIGS. 10 and 11 show a pattern of cuts to produce a generally square central aperture; FIGS. 12 and 13 show a pattern of cuts to produce a generally D-shaped central aperture; and FIGS. 14 and 15 show a pattern of cuts to produce a rounded triangular central aperture.

A particular advantage of the invention is that it provides the manufacturer with a wide variety of options to use an inventory of used tires of different sizes. If there are surplus tread portions, a FIG. 3 type embodiment can be used. If a surplus of sidewalls arises, then the other designs can be favored. All designs have in common the feature that they produce base units which make use of used tires, which are low in overall height, which incorporate an anti-rolling aspect by virtue of the irregular external shape, which provide a low center of gravity for excellent stability, and which are relatively safe in the event of impact, particularly in view of improved separability.

In addition to the advantages which are described or apparent from the above, it should be mentioned that the structure of the invention provides increased rigidity across the entire base, which significantly increases the resistance to overturning. The center of gravity of the overall unit is also lower, and the weight is more distributed across the base, which further enhances stability.

Figure 4:
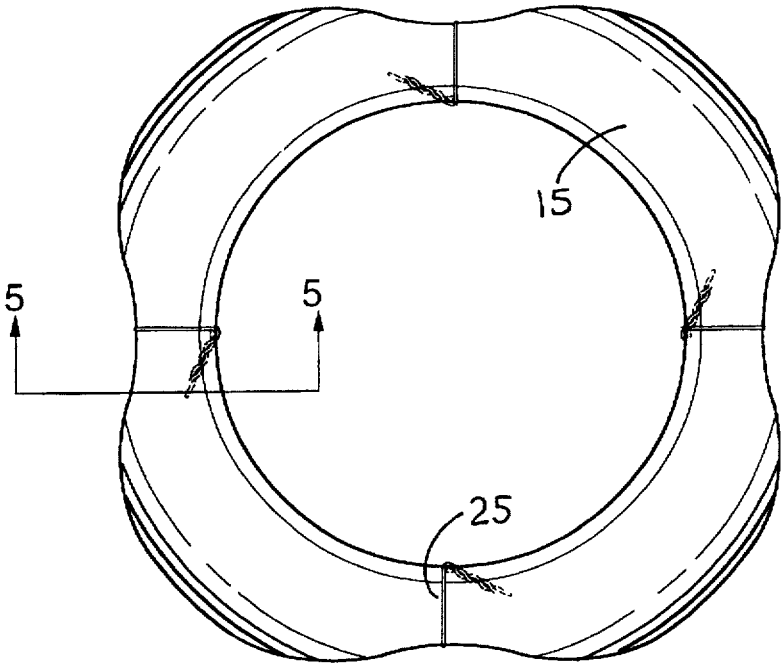
FIG. 4 is a plan view of the base.
Figure 5:
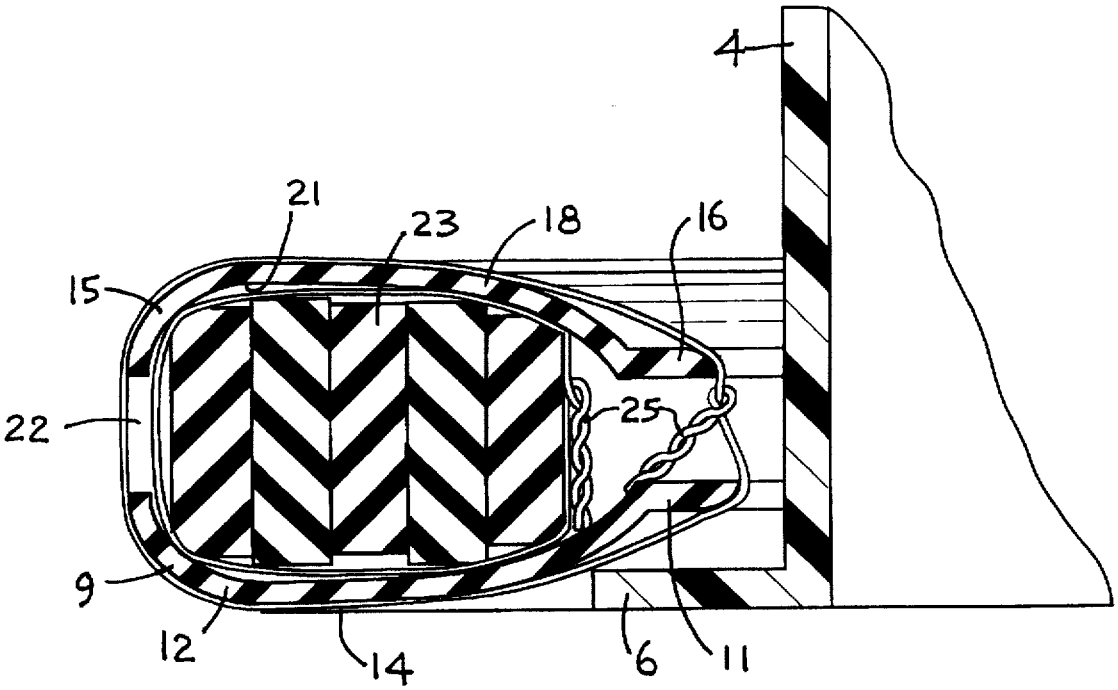
FIG. 5 is a cross-section at 5—5 of FIG. 4.
Figure 6:
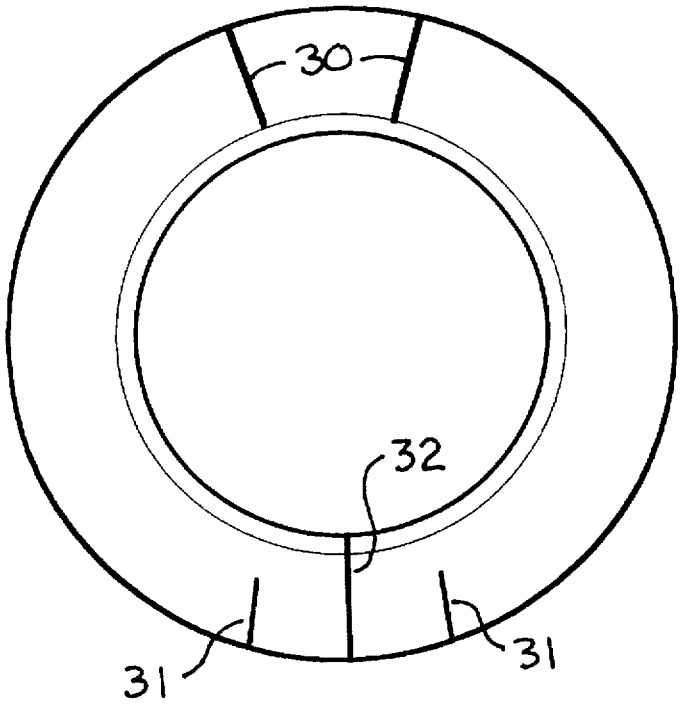
FIG. 6 is a plan view of a sidewall, showing a pattern of cuts to produce an oval central aperture.

It should be clearly understood that the upper and lower sidewalls could be tied to produce any desired irregular shape, not just the shape shown in FIG. 4. Similarly, the cuts for the inner sidewalls obviously could be varied to produce any desired internal shape, not just those shown in FIGS. 6–15.

What is claimed as the invention is:

1. A base unit for use in association with a body portion of a traffic channelizing device, the base unit having a substantially circular lower base portion comprising a sidewall of a vehicle tire, said sidewall having an inner planar section and an integral outer curved section providing a substantially circumferential convex ground contacting surface, and a substantially circular upper base portion comprising a separate sidewall of a vehicle tire, said sidewall having an inner planar section and an integral outer curved section, disposed to form an annular concave channel between said upper and lower base portions, and at least one additional portion of at least one vehicle tire retained at least partially within said annular channel means, where said sidewalls are tied to produce an irregular outer shape, such that the device is not prone to rolling when overturned.

2. A base unit as recited in claim 1, where said at least one additional portion comprises at least one tread portion of a least one vehicle tire.

3. A base unit as recited in claim 2, where said at least one tread portion is wound in a spiral configuration and is secured as an integral unit by a securing means.

4. A base unit as recited in claim 1, where said at least one additional portion comprises said sidewall oriented generally horizontally, said sidewall being severed at at least one location to produce two free ends, and having at least one of additional cuts extending a substantial portion of the distance from an outer edge of said sidewall towards an inner edge thereof to facilitate deformation of the sidewall, said free ends being overlapped and secured to each other so as to form, by means of said additional cuts, an internal shape other than circular.

5. A base unit as recited in claim 4, where said at least one additional cuts comprises two cuts less than 45 degrees from each other generally centered between said free ends, whereby a generally oval shape may be defined.

6. A base unit as recited in claim 4, where said at least one additional cuts comprises four cuts approximately 90 degrees, said free ends being generally centered between two of said additional cuts, whereby a generally square shape may be defined.

7. A base unit as recited in claim 6, further comprising three cuts from the inner edge of said sidewall partway towards the outer edge, one of each of said three cuts being positioned approximately midway between said cuts from said outer edge cuts, excluding said free ends.

8. A base unit as recited in claim 4, where said at least one additional cuts comprises two cuts each generally about 45 degrees from said free ends, whereby a generally D-shaped shape may be defined.

9. A base unit as recited in claim 4, where said at least one additional cuts comprises two cuts each approximately 120 degrees from the other and from said free ends, whereby a curved generally triangular shape may be defined.

* * * * *